US005212928A

United States Patent [19]

Scott et al.

[11] Patent Number: 5,212,928

[45] Date of Patent: May 25, 1993

[54] CLOSURE STRAP FOR FLEXIBLE CONTAINERS AND APPARATUS AND METHOD FOR TENSIONSING THEREOF

[75] Inventors: Ernest D. Scott, Delray Beach, Fla.; Donald L. Tedder, Carrollton, Ga.; Gregory Scott, Jacksonville Beach, Fla.

[73] Assignee: Edge Technology Corporation, Delray Beach, Fla.

[21] Appl. No.: 621,215

[22] Filed: Nov. 30, 1990

Related U.S. Application Data

[63] Continuation-in-part of Ser. No. 503,281, Apr. 2, 1990, abandoned.

[51] Int. Cl.[5] ..... B65B 51/08

[52] U.S. Cl. ..... 53/417; 53/139.1; 140/93 A; 140/123.6

[58] Field of Search ..... 53/417, 138.2, 138.3, 53/139.1; 140/93 A, 123.5, 123.6

[56] References Cited

U.S. PATENT DOCUMENTS

| | | | |
|---|---|---|---|
| 3,891,012 | 6/1975 | Bakermans | 140/93 A |
| 4,119,124 | 10/1978 | Collier | 140/123.6 |
| 4,202,384 | 5/1980 | Aubert | 140/123.6 |
| 4,321,952 | 3/1982 | Natkins | 140/123.6 |
| 4,371,010 | 2/1983 | Hidassy | 140/123.6 |
| 4,390,047 | 6/1983 | Kaneko | 140/123.5 |
| 4,561,475 | 12/1985 | Hinden | 140/123.5 |
| 4,901,775 | 2/1990 | Scott | 140/123.5 |

*Primary Examiner*—John Sipos

*Attorney, Agent, or Firm*—Malin, Haley, DiMaggio & Crosby

[57] ABSTRACT

A method for drawing a bundling strap taut about the neck of a flexible container such as a bank bag, said bundling strap comprised of an elongated body portion having a plurality of serrations disposed along side edges thereof adapted to mate in locking contact with corresponding teeth members projecting into an aperture in a head-end portion connected to said strap body, the method utilizing an automatic bundling strap tensioning apparatus characterized by a reversible motor means connected to a reciprocating means for gripping moveable between an extended position and a retracted position, comprised of the steps of:

looping said bundling strap about the open neck of said flexible container;

inserting the tail end of the strap through the aperture defined by the head-end portion of the strap;

pulling said tail-end of said strap completely through said aperture until at least the first set of serrations of the strap body are engaged by said teeth members projecting upwardly into the interior of the aperture, thereby locking the strap body against reverse movement relative to said head-end portion;

inserting the tail-end portion of the strap in said means for gripping;

causing said means for gripping to move from the extended to the retracted position, thereby pulling the strap body further through said aperture and closing the neck of the flexible container.

1 Claim, 6 Drawing Sheets

CLOSURE STRAP FOR FLEXIBLE CONTAINERS AND APPARATUS AND METHOD FOR TENSIONSING THEREOF

BACKGROUND OF THE INVENTION

This application is a continuation-in-part of copending application Ser. No. 07/503,281, filed Apr. 2, 1990 now abandoned.

FIELD OF THE INVENTION

This invention relates generally to bundling or tie straps of the character disclosed in U.S. Pat. No. 3,022,557, and more particularly relates to a one-piece bundling strap manufactured from a single material having means to ensure the firm gripping of the tail end of said strap within the apertured self-clinching head end portion thereof against reverse movement of the strap body relative to said head-end portion, means being associated with said bundling strap to indicate the presence of tampering. An apparatus and method for tensioning said bundling strap is also disclosed.

PRIOR ART

Flexible bundling straps adapted to be looped about a plurality of loose elements or about the neck of a flexible container and drawn taught thereabout in self-clinching relationship are well known. Bundling or tie straps of this nature are comprised of an elongated flexible strap adapted to be wrapped around a plurality of items to be bundled or about a pouch to be sealed (eg: cloth bag or money-carrying bag), pulled taut and held taut by a relatively rigid tongue disposed within the head-end of the strap. The head-end has a through-aperture therein adapted to receive the opposite or tail-end of said strap, said tongue adapted to coact with the tail-end of said strap so as to retain the strap against reverse movement thereof.

An example of a tie or bundling strap of this nature is disclosed in U.S. Pat. No. 3,186,047 to Schwester et al. The apertured head-end portion of Schwester has a self-clinching tongue means but which must be inserted into the head-end portion at a predetermined angle using an additional step in the process of manufacturing the strap, increasing the cost thereof. Undetected tampering may be accomplished by prying and removing the tongue means from clinching engagement with the strap body using a thin, sharp implement, and slipping the strap out of the aperture in the head-end. Tampering may also be accomplished by deforming the head-end, thereby releasing the tongue. This would allow the bundled items to be unbundled or the closed pouch to be opened and access gained to the interior thereof. Thereafter the items may be rebundled or pouch reclosed using the same strap without evidence of tampering.

A further effort at providing a tamper-proof bundling strap of the type here under consideration is disclosed in applicants' U.S. Pat. No. 4,902,055, which is directed to a security cap adapted to cover the head-end portion of the bundling strap and thereby preclude access to said tongue means. The cover is comprised of a generally flat sheet of semi-rigid or rigid material bent along transverse axes into a three-dimensional generally rectangular member. Through openings are provided therein which correspond with the positions through which the thin bundling strap body is passed when in use. Such a structure, however, is relatively costly to produce and time consuming and cumbersome to use, but is nevertheless effective.

Devices for tensioning and securing such straps about the neck of a bank bag or other item(s) to be bundled have heretofore been exclusively manually operable and cumbersome. These devices have primarily been hand-operated seal presses utilizing a fabric-type cord secured in taut relationship about the neck of the currency bag by means of a quantity of lead which is crimped by the hand-operated seal press and thereby deformed, forming a tight grip about said cord. An example of this type of hand-operated seal press is embodied in U.S. Pat. No. 3,911,970 to Lundberg et al. The process of bundling the neck of a currency bag using these hand-operated devices is extremely time consuming.

A radical improvement in the state of the art strap tensioning field is presented in applicants' U.S. Pat. No. 4,901,775, which is hereby incorporated by reference herein and set forth in part hereafter.

It is therefore a principal object of the present invention to provide a means for automatically and rapidly securing a self-clinching bundling strap about the neck of a flexible container or other item(s) to be bundled.

It is a further object of the present invention to provide a method for automatically tightening a novel bundling strap about the neck of a currency bag using an apparatus which is lightweight and accomplishes its task consistently and a multiple of times faster than the heretofore hand-operated devices.

It is also a principal object of the instant invention to provide an improved self-clinching tamper-proof bundling strap.

It is a further object of the present invention to provide a tamper-proof self-clinching bundling strap having locking means wherein the body portion thereof is adapted to be locked by a novel and inexpensive locking means against reverse movement throughout its length when looped upon itself and drawn through its apertured head-end portion.

It is a still further object of the present invention to provide a novel tamper-proof self-clinching bundling strap manufactured as a single piece from a relatively brittle material which will fracture when exposed to predetermined tampering forces.

In accordance with these and other objects which will be apparent hereinafter, the instant invention will now be described with particular reference to the accompanying drawings.

SUMMARY OF THE INVENTION

There is disclosed herein a tamper-proof bundling strap comprised of a head-end portion defining an aperture therethrough, said head-end portion being integrally connected to an elongated narrow body portion, said aperture in said head-end portion corresponding generally to the cross-sectional configuration of said body portion. The head-end portion and the body portion comprise a locking means integrally associated therewith for preventing reverse movement of said body portion relative to said head-end portion when said body portion is looped upon itself and disposed within the aperture of said head-end portion. The locking means is comprised of a plurality of serrations or ratchet teeth oriented along a portion of the length of said body portion and a plurality of projecting teeth members or pawls disposed within said through aperture adapted to lock against reverse movement of said serrations therethrough when said body portion is drawn through the aperture in the head-end portion.

The strap is a one-piece unit constructed of a single, preferably brittle, material which will fracture when exposed to tampering forces. The strap of the instant invention is ideally suited for use with the applicants' automatic seal tensioning machine disclosed in their U.S. Pat. No. 4,901,775.

To this end, the tail-end of the body portion may be tapered to facilitate unencumbered placement of the body portion within the jaws of the automatic tensioning device.

The teeth members of the locking means project into the aperture in said head-end portion at an angle such that the body portion can be passed through the head-end in one direction with minimal resistance but cannot be moved in the reverse direction because the outer surfaces of said teeth members mate in planar association with a steep trailing surface of any given serration, thereby preventing the body portion from being removed from said head-end portion.

Detents may be disposed in the body portion of the strap, thereby creating stress raisers along which the strap will fracture if tampered with.

The bundling apparatus used to carry out the method of this invention is comprised of a hand-operated automatic tensioning machine for pulling taut to a predetermined tension a self-clinching bunding strap about an article to be protected such as the neck of a currency bag. The machine is comprised generally of a means for rotating an output shaft, as for example a hand-held electric screwdriver motor and hand-held housing unit therefore, having associated therewith an on/off switch normally biased to the "off" position, said output shaft being coupled to an externally threaded rod which is disposed to rotate about its elongate axis by way of a bearing means at the end of said rod opposite the coupling with said output shaft. An internally threaded guide block means is disposed for linear reciprocal movement along the elongate length of said externally threaded rod. Means for gripping the body portion cf said strap are rotatably associated with said guide block means. As the threaded rod rotates, the threads thereon rotate, causing the guide block means to move linearly by virtue of the meshing interconnection of the rod threads with the internal threads of the guide block means.

In use, the strap body is looped about the item(s) to be bundled, and the tail end of the strap body brought into engagement with the gripping means. Thereafter, movement of the guide block means away from item(s) causes said gripping means to firmly engage, and preferably roll mark the strap body with identifying indicia, while pulling the strap body taut to a predetermined tension.

The shaft/gripping means arrangement is positioned within a protective housing means which corresponds generally with the elongate axis of said rod and connects to the output shaft-end of said hand-held reversible motor housing unit to form one integral unit therewith.

It should be noted that for purposes of this disclosure, "distal" shall mean toward the left in the figures and "proximal" shall mean toward the right in the figures. The distal end of said housing means defines an aperture corresponding generally to the shape of the body portion of said bundling strap so that the tail-end of said bundling strap may be passed through said aperture and placed into locking engagement with said gripping means, which gripping means is positioned at the distal end of said rod when the sealing operation is commenced. The machine means is then actuated, the output shaft and rod begin to rotate, which thereby causes the gripping means to move linearly toward said machine means and away from said currency bag, thereby pulling the bundling strap along with it because of frictional interconnection between said gripping means and the strap body. The bundling strap has already been placed about the open neck of a currency bag or other item(s) to be bundled. The gripping means is drawn backwardly along said rod so as to pull the bundling strap tightly through the head end portion of said strap and around the neck of the currency bag or other item(s) to be bundled. Self-clinching means are provided within the bundling strap so that the strap will remain tight about the bundled bag without loosening. The self-clinching means may be, for example, a semi-rigid sharp projection which engages the body of the tautly sharp projection which engages the body of the tautly pulled bundling strap against reverse (or loosening) movement.

The hand-held unit is provided with a power means having adjustable automatic shut-off and reverse direction features which are actuated when the gripping means fully reaches both the proximal and distal ends of the threaded rod or when it reaches said predetermined tension so as to avoid producing undue stresses within the invention as a whole or any of its components.

The instant invention also comprises a method for drawing a bundling strap taut about the neck of a flexible container such as a bank bag, comprised of the steps of:

looping a bundling strap about the open neck of a flexible container;

inserting the tail end of the strap through an aperture defined in the head-end portion of the strap;

pulling said tail-end of said strap completely through said aperture until at least the first set of serrations disposed along opposed side edges of the strap body are engaged by teeth members projecting upwardly into the interior of the aperture, thereby locking the strap body against reverse movement relative to said head-end portion;

inserting the tail-end portion of the strap between a pair of strap body gripping jaws which are disposed for reciprocal movement within an automatic bundling strap tensioning apparatus, said gripping jaws adapted to move linearly between an extended position and a retracted position;

causing said position gripping jaws to move from the extended to the retracted position, thereby pulling the strap body through said aperture and closing the neck of the flexible container;

causing said gripping jaws to move from the retracted toward the extended position to release the strap body from engagement between said gripping jaws.

A further step may be added to the above recited method of imprinting the strap body with indicia using indicia printing means associated with said gripping jaws adapted to imprint indicia upon the strap body, preferably at indicia receiving area "I" located on the strap body.

The invention will now be described in detail with particular reference to the following drawing figures.

DETAILED DESCRIPTION OF THE PREFERRED EMBODIMENT

Figure 1:
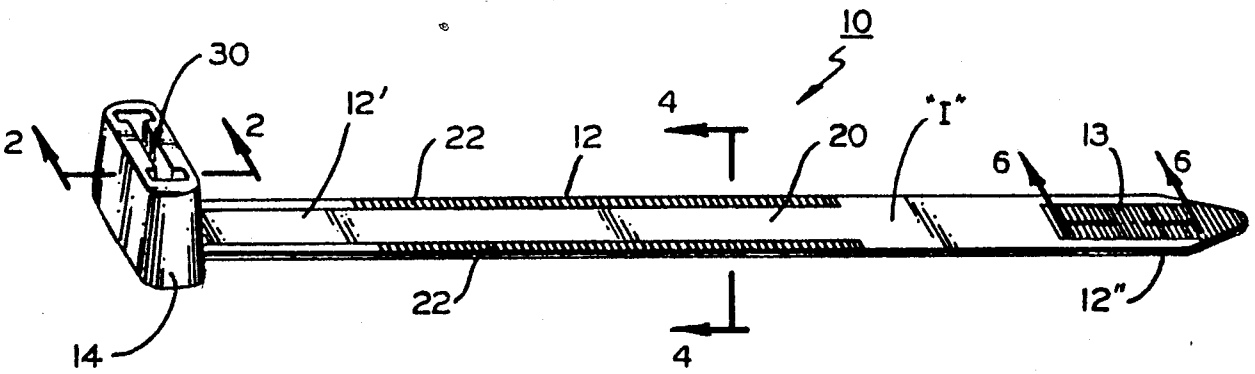
FIG. 1 is a perspective view showing the novel tamper-proof bundling strap of the instant invention.
Figure 4:
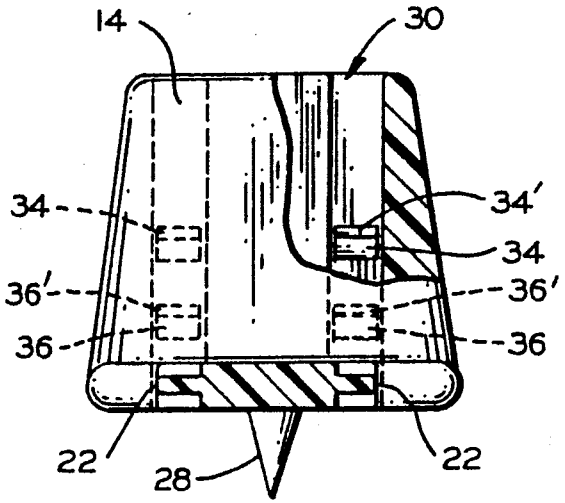
FIG. 4 is a cross-sectional view of the invention taken along lines 4—4 of FIG. 1.

Referring to the drawings, the improved bundling or tie-strap is referred to throughout generally by the reference numeral 10. Said strap 10 is comprised of a narrow elongated body portion 12 having integrally connected at its head-end 12' a head-end member 14 which defines an H-shaped aperture 30 therein corresponding generally to the cross-sectional dimensions of said body portion 12. Tail end 12" of strap portion 12 may have integrally formed therein a plurality of spaced, parallel, relatively narrow grooves 13 to act as a finger grip portion.

Figure 2:
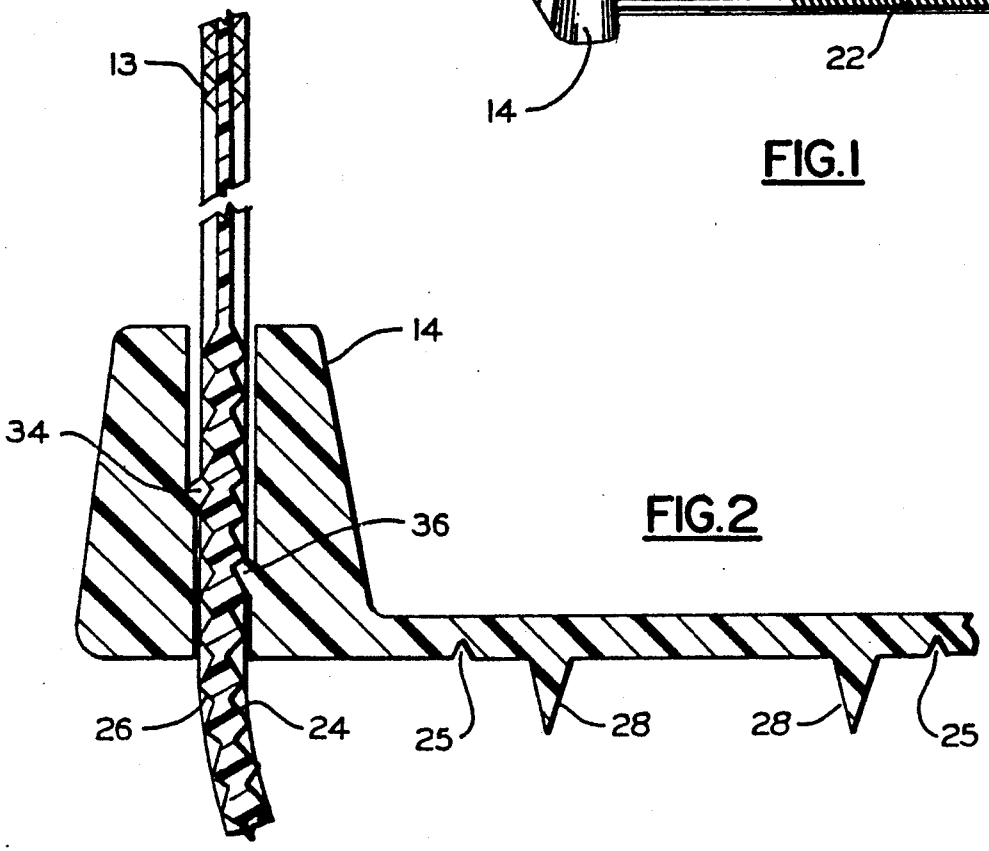
FIG. 2 is a partial sectional view thereof taken along lines 2—2 of FIG. 1.
Figure 6:
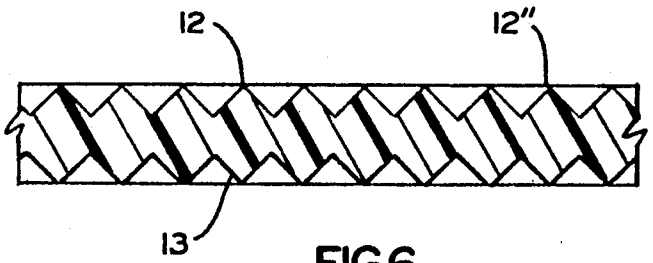
FIG. 6 is a partial cross-sectional view taken along lines 6—6 of FIG. 1.

Serrations 22 are provided along the sides of both top and bottom surfaces of strap body 12 extending from a point near head end 14 and ending at area "I", and are adapted to coact with projecting teeth members 34 and 36 disposed within aperture 30 of head-end 14. The profile of each serration is preferably that of an oblong diamond, wherein the leading surface 24 thereof is longer than the trailing surface 26. The pitch of trailing surface 26 is preferably generally parallel to the mating surface 34' or 36' of projecting teeth members 34 and 36, respectively, when body portion 12 is disposed within aperture 30 of head-end 14. The pitch of the leading surface 24 is longer and less steep in profile to facilitate the insertion of body member 12 into and through aperture 30. Teeth members 34 and 36 are angled as seen in FIG. 2 to allow the strap body 12 to pas thereover during insertion into the head 14 but to prevent removal thereof in the opposite direction.

Teeth 34 and 36 mesh tightly with trailing surfaces 26 so as to prevent tampering with said teeth. Teeth 34 and 36 are also hidden by surfaces 24 and 26 providing a shield against tampering.

Figure 5:
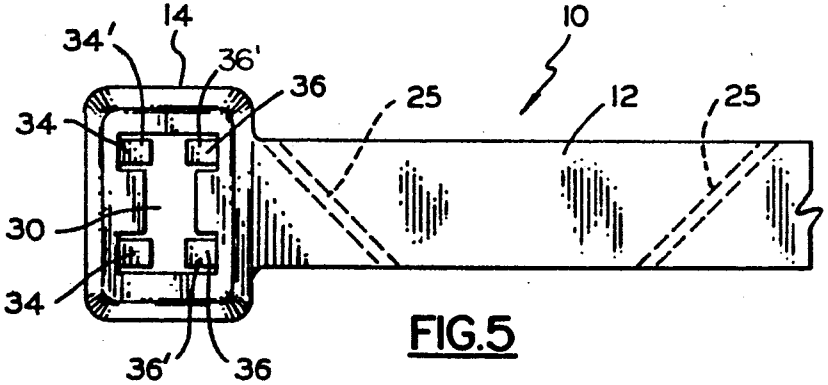
FIG. 5 is a partial plan view showing the head-end portion and teeth members therein.

As best seen in FIG. 5, teeth members 34 and 36 are preferably formed out of the material of strap 10 as through injection molding, casting, or stamping into the preformed strap. In the preferred embodiment, teeth members 34 and 36 are formed integrally with head-end 14 near the outer side edges of aperture 30 and thereby in corresponding position with serrations 22 near the outer sides of strap body 12. Said teeth may in the alternative be positioned more closely to each other and the serrations positioned correspondingly on strap body 12. However, it is preferred that a blank area be left as at I in FIG. 1 to accommodate the imprinting of identification indicia thereon. For example, the strap of the instant invention may be used with the automatic strap tensioning apparatus shown in FIGS. 8–15 and depicted in phantom as 50 in FIG. 3. The gripping jaws 84 and 85 of that apparatus grip strap body 12 near tail end 12" and pull strap 10 taut about the item or items to be bundled. Said jaws 84 and 85 may be provided with raised markings on at least one of their opposed gripping surfaces which will leave an impression on the strap body in indicia marking area "I" for identification when the jaws are translated rearwardly during the tensioning operation, described in fuller detail below. Also, or in the alternative, indicia may be imprinted upon head 14 in any convenient manner.

Referring now to FIGS. 3 and 8–12, reference numeral 50 designates the automatic seal tensioning machine which is comprised of a hand-held unit 54 housing a reversible motor means (not shown) having a rotating output shaft 56. The motor means is preferably actuatable by a normally open on/off switch controlled by trigger 55. The motor is powered and controlled logically by a remote controller unit 120, to be described more fully hereinafter. Remote controller 120 is electrically communicated to said automatic seal machine 50 by means of an electrical cable 58 or the like. Pin connectors or other suitable electrical connecting means 121 may be employed to communicate cable 58 with the motor means and with remote controller unit 120.

Figure 10:
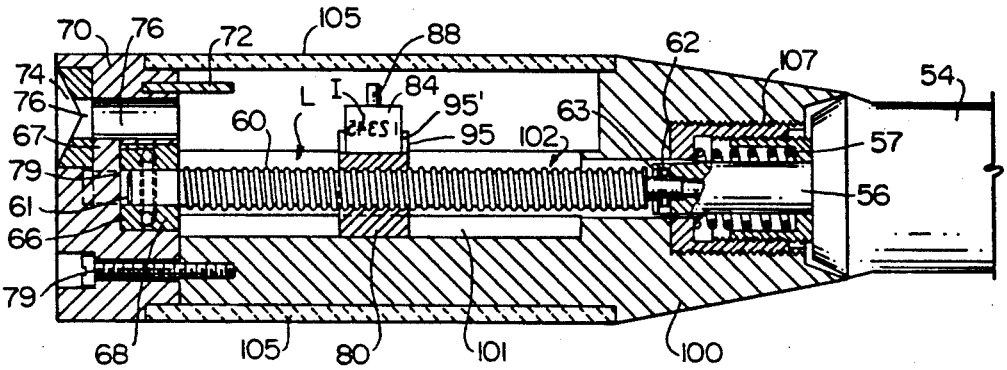
FIG. 10 is an elevational cross-sectional view of the tensioning apparatus taken along lines 10—10 of FIG. 8.

Output shaft 56 of said motor means is coupleable to a rotatable threaded elongated rod 60, preferably by means of a transverse pin 62 which is sized and shaped to engage a corresponding detent 63 disposed within the end of output shaft 56, as best shown in FIG. 10.

Figure 8:
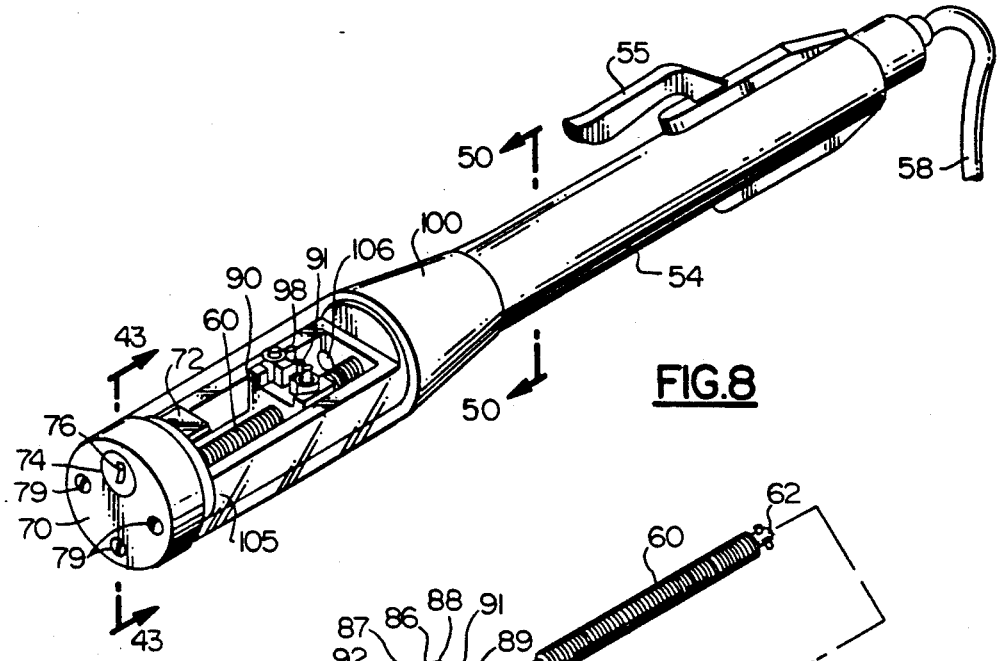
FIG. 8 is a perspective view of the tensioning apparatus of this invention.
Figure 9:
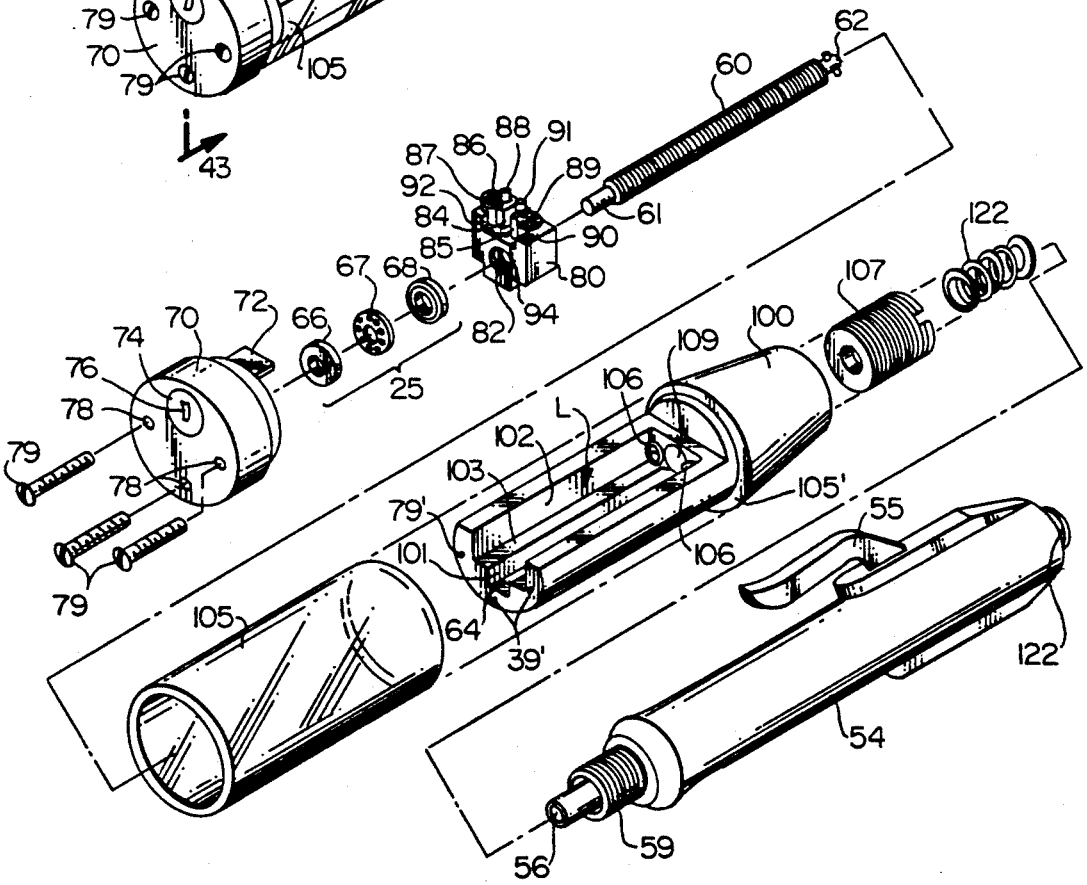
FIG. 9 is an exploded view of the tensioning apparatus showing the interior detail thereof.

Referring now to FIGS. 8–10, hand-held unit 54 is provided with external threads 59 at its distal end which are adapted to engage in mating contact an internally threaded collar 107 threadingly connected to shaft housing 100. Housing 100 is configured to generally surround the apparatus of the strap tensioning mechanism in a manner which will be set forth herein. Housing 100 is comprised of a generally cylindrically shaped body portion, which may have a tapering proximal end portion. Housing 100 is adapted to join hand-held unit 54 in threading engagement at threads 59 and 59'. Sandwiched therebetween is slip-clutch spring 57 which provides compressive force against a slip-clutch mechanism disposed within hand-held unit 54 in a conventional manner. In the preferred embodiment, internally and externally threaded collar 107 mates housing 100 with threads 59' of hand-held unit 100. Spring 57 contacts collar 107 at the distal end thereof. The position of collar 107 within housing 100 is adjustable by turning said collar 107 either clockwise or counterclockwise when viewed from its proximal end depending upon whether it is desired to increase or decrease the force exerted by spring 57 between housing collar 107 and hand-held unit 54. Increasing the force borne by spring 57 increases the pressure on the hand-held unit motor slip clutch (not shown) which in turn increases the amount of tensioning force which said motor may exert on a bundling strap being tensioned before said slip clutch will fail to provide any gripping force and allow the motor in unit 54 to spin freely. In an alternative embodiment, the adjustment feature of collar 107 would be replaced by interchangeable springs 57 having differing spring constants.

Figure 11:
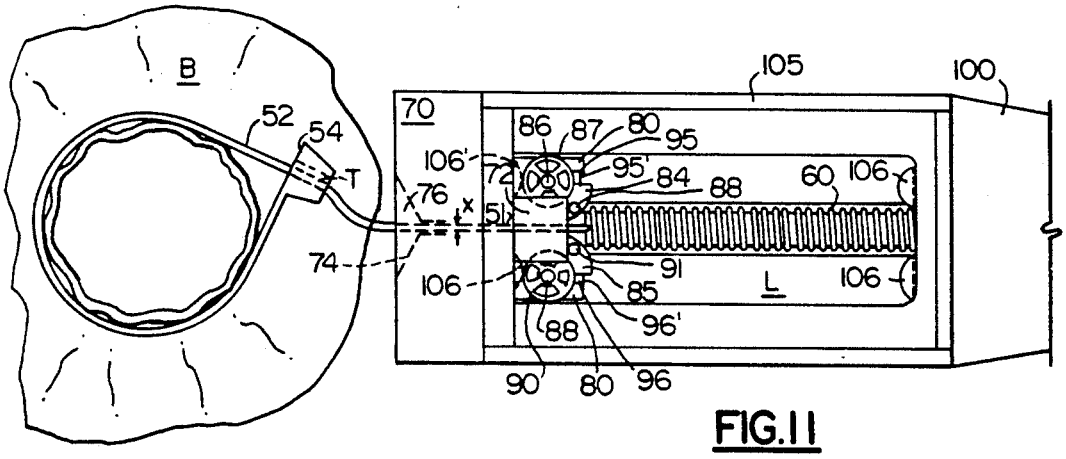
FIG. 11 is a plan view of the tensioning apparatus after receiving the tail-end of the bundling strap between the gripping jaws, where the bundling strap is inserted into the gripping means but not yet pulled tightly about the neck of a currency bag.
Figure 12:
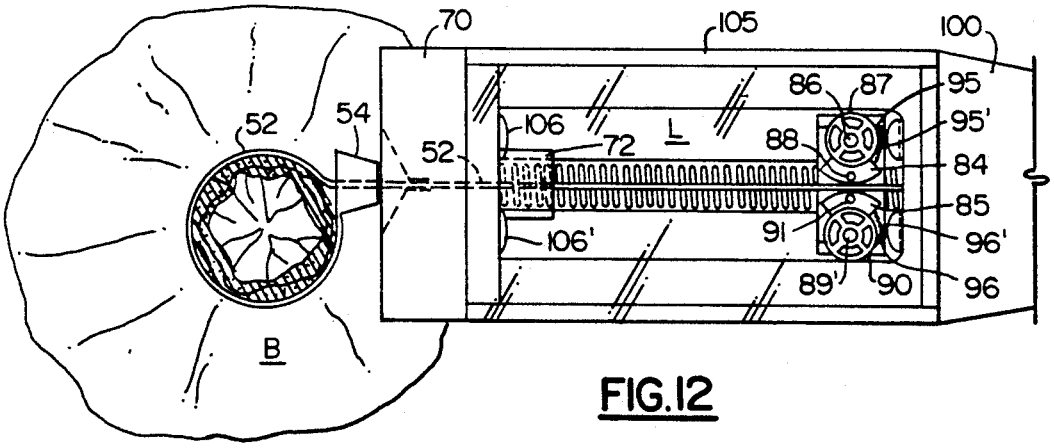
FIG. 12 is a plan view of the tensioning apparatus where the bundling strap has been pulled tightly about the neck of the currency bag.

Housing 100 has cut out therefrom a generally Y-shaped channel L conforming generally to the elongate length of housing 100 and comprised of a lower floor portion 104, adjoining lower vertical walls 101, a pair of upper floors 103 and upper vertical walls 102. At the proximal and distal ends of said channel L may be positioned a pair of resilient damping members 106 and 106', respectfully. Surrounding said elongated channel L is a cylindrical safety collar member 10 adapted to fit snugly about the exterior of housing 100, the proximal end thereof adapted to engage a raised shoulder portion 105' of housing body 100 in abutting relationship. Threaded screw or bolt openings 79' are disposed in the distal end of housing body 100. Housing body 100 has a bore 109 through its proximal end along the central axis thereof through which passes the proximal end of rod 60. The distal end of rod 60 adapted to ride in free spinning association within a bearing means 65. Bearing means 65 may be comprised of a pair of ball bearing race members 66 and 68 sandwiching a series of lubricated ball bearings enclosed within a disk shaped collar 67. Said bearing means 65 is centrally disposed within the proximal end of end cap means 70. End cap means 70 is removably connected to housing 100 by way of fastening means. Said fastening means are preferably comprised of a series of screws or bolts 79 disposed through openings 78 in end cap 70 for threading engagement with threaded openings 79' in housing body 100. In this way end cap means 70 is rigidly connectable to hand-held unit 54. When assembled, as shown in FIGS. 8 and 10, screws 79 are threaded into openings 79' in housing 100, which thereby sandwiches collar 105 between the proximal end of housing 100 and end cap 70. In this manner, the rod 60 and strap gripping means may be viewed readily. Disposed within end cap 70 is a seal follower 74 having an aperture 76 therein sized and shaped to correspond to the width and thickness dimensions of the body of a bundling strap 10, as best shown in FIGS. 11 and 12. Attached to the upper proximal end of end ca 70 is a rectangular plate or cam opener 72 which is disposed generally directly above aperture 76. Said cam opener 72 is designed to release the gripping means, to be discussed below, after the bundling strap tensioning operation is completed.

Slidably disposed within channel L of housing 100 is a means for gripping said bundling strap body 12 and for tensioning said bundling strap about the neck of a bank bag or other item(s) to be bundled. The gripping means is comprised, in the preferred embodiment, of a guide block 80 corresponding generally to the shape of channel L having disposed therethrough an internally threaded bore adapted to engage the threads of shaft 60 in mating association.

Guide block 80 has associated therewith at its upper end a pair of spaced apart shear pins 86 and 89 adapted to act as rotating axes for a pair of partially rotatable cam members 84 and 85, respectively. Said cam members have a pair of opposed facing surfaces spaced apart a distance slightly greater than the thickness of strap body 12 measured in the direction indicated by the letter x shown in FIG. 11 when said cam members 84 and 85 are in the open position shown in FIGS. 8 and 11. Cam members 84 and 85 move in a cam action manner so that their opposed strap gripping faces are slightly closer together when in the closed position shown in FIG. 12 than they are when in the open position shown in FIG. 11. In this way, said cam members squeeze strap 12 when moved from their open toward their closed position.

Cam members 84 and 85 have connected thereto a pair of cam opener contact pins 88 and 91, respectively, adapted to contact cam opener 72 after a tensioning operation is performed. Cam members 84 and 85 each have disposed therein a bore through which are passed said shear pins 86 and 89, leaving said cam members 84 and 85 free to rotate about shear pins 86 and 89, respectively. Cam members 84 and 85 are free to rotate on shear pins 86 and 89, respectively, only to the extent allowed by surfaces 92 and 94 in one direction and surfaces 95 and 96 of guide block 80, as best shown in FIGS. 10 through 12. In this manner, during the tensioning operation that occurs between FIGS. 11 and 12, cam members 84 and 85, respectively, are rotated by virtue of the frictional interconnection between said cam member and the strap body 12 until they abut surfaces 92 and 94, respectively. Conversely, after the tensioning operation is carried out, the direction of rotation of rod 60 is reversed, causing guide block 80 to traverse from the proximal end to the distal end of said rod 60. Once cam opener contact pins 88 and 91 are brought into contact with cam opener 72, cam members 84 and 85 are forced to rotate in the opposite direction from that above identified, thereby relieving the frictional interconnection between said cam members 84 and 85 and strap body 10. Surfaces 95 and 96 are employed, therefore, to limit the amount of rotation of cam members 84 and 85 brought about by cam opener 72.

A pair of springs 95' and 96' are connected to cams 84 and 85 which act on guide block 80 at surfaces 95 and 96 to maintain cam members 84 and 85 in a predetermined, partly closed, position so that they may receive a new strap 12 prior to each tensioning operation without binding. Said springs assure that cam members 84 and 85 will receive the new strap body I2 under equal force conditions so that each said cam member will exert equal frictional and compressive forces on strap body 12 through successive iterations of the method described herein.

Retaining rings 87 and 90 may be employed to fix cam members 84 and 85 in rotatable association with guide block 80 as best seen in FIGS. 9, 10 and 11.

Control unit 120 is electrically connected to hand-held unit 54 by a conductor carrying cable 58. A pin connection means 121 is preferably employed to electrically connect cable 58 with the electronic circuitry within control unit 120 and with unit 54. However, other suitable electrical connecting means may be employed such as direct wiring, ribbon cable connection, or other appropriate means of connection.

Figure 13:
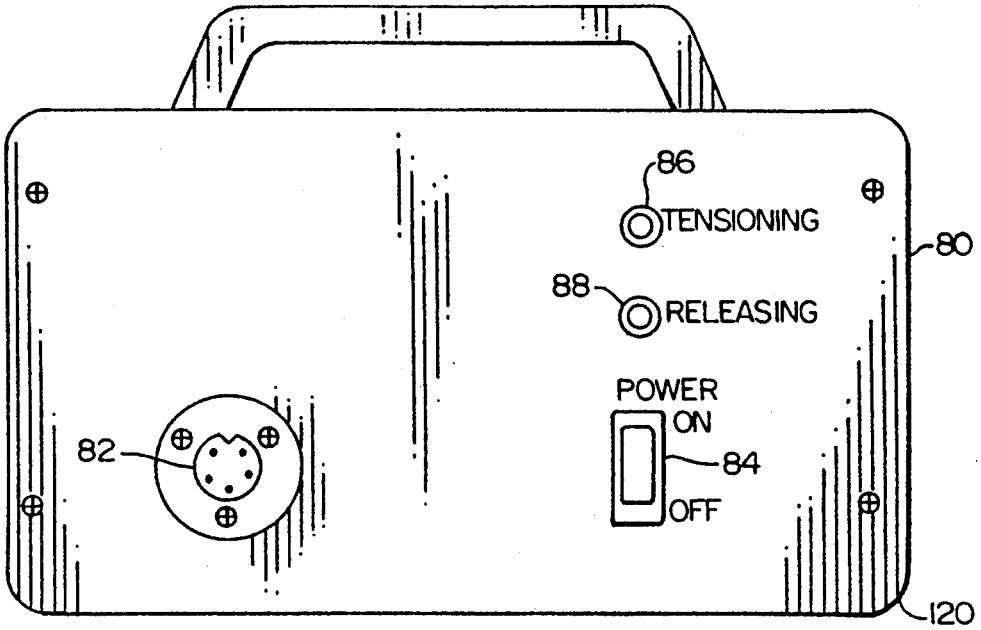
FIG. 13 is a front elevational view of a housing for a power and direction control means.
Figure 14:
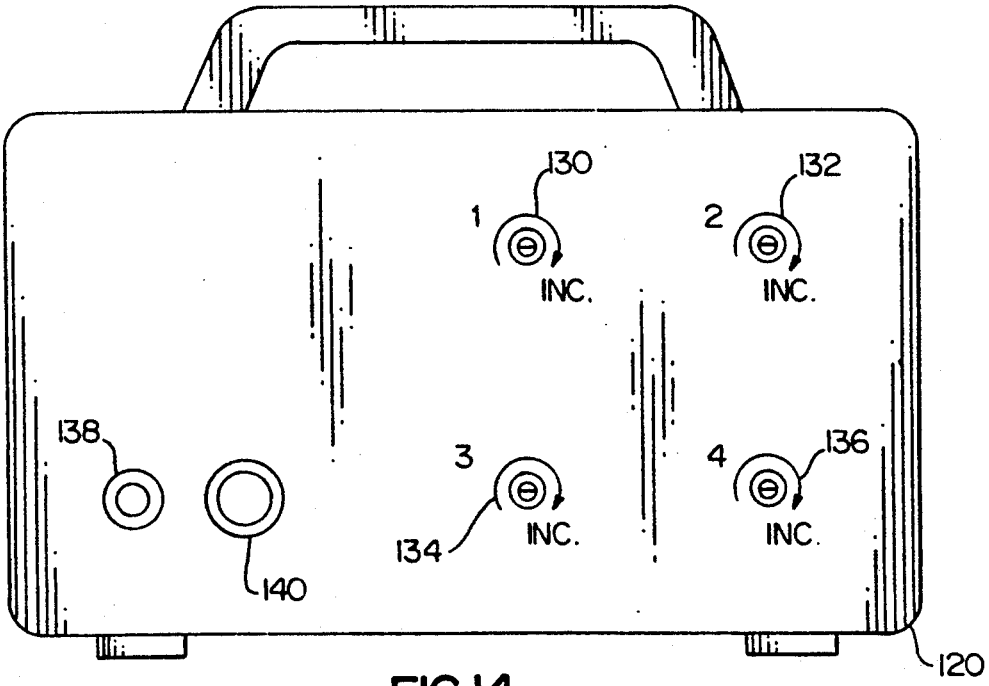
FIG. 14 is a rear elevational view of said housing.
Figure 15:
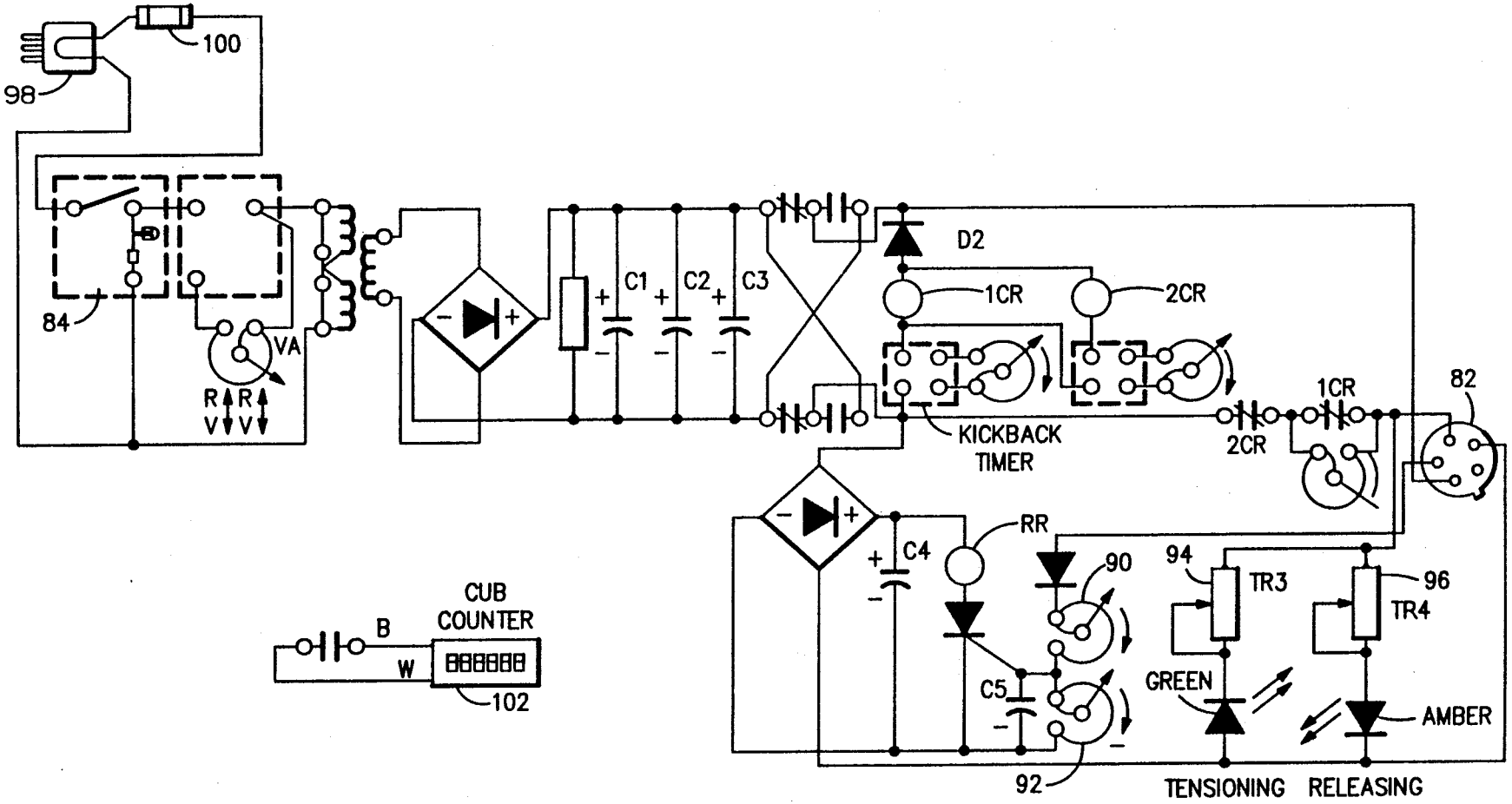
FIG. 15 is a schematic diagram of the power and direction control means.

As best shown in FIGS. 13 through 15, control unit 120 is provided with an on/off switch 124, tensioning operation indicator light 126 and releasing operation indicator light 128. Power from a remote source such as a wall outlet is provided through opening 138 on the reverse side thereof, shown in FIG. 14. Protection against power surges or other electrical malaise may be provided in the form of a fuse or fuseable link 140. Means for adjusting the operational characteristics of the strap tensioning device 50 are provided by variable timers 130 and 134 and variable resistors 132 and 136. A digital display (not shown) may be provided to indicate the tensile force exerted by the gripping means on the strap 12. Tensile forces generated in strap 12 are dependent upon and are a function of the adjustment of adjusting means 132 and 136.

Timer 130 may be referred to as a reverse mode kick-back timer which causes a delay between the time the motor means is disabled and the time it is re-enabled, as when the direction of rod 60 is reversed. Such a reversal occurs when it is desired to change the direction of movement of guide block 80. For example, as shown in FIG. 11, to begin the tensioning operation, strap body 12 is placed between cam members 84 and 85, at which time guide block 80 is at the distal end of rod 60. Thereafter the motor means is energized by the circuit of FIG. 8 causing rod 60 to rotate in the counter-clockwise direction when viewed from the distal end of rod 60, thereby causing guide block means to move from the left to the right of FIG. 11. This movement simultaneously causes cam members 84 and 85 to rotate into abutting engagement with surfaces 92 and 94, respectively, thereby frictionally engaging strap body 12 and pulling it along at the same speed and in the same direction of travel as guide block 80. Continued movement of guide block 80, and hence cam members 84 and 85, pulls strap 12 into tight bundling position about the neck of currency bag B.

Upon a predetermined load being exerted by strap 12 on cam members 84 and 85, and hence guide block 80, which load is also thereby exerted against the rotation of rod 60, motor means is disabled by the circuit shown in FIG. 15 and instantaneously re-energized in the opposite direction, thereby causing shaft 60 to rotate in the clockwise direction when viewed from its distal end. This will cause guide block 80 to travel from right to left in FIGS. 11 and 12 until cam opener 72 contacts cam opener contact pins 88 and 91, causing cam members 84 and 85 to come into abutting contact with surfaces 95 and 96, respectively. When this occurs, the load exerted by guide block 80 on rod 60 causes motor means to be reversed by the circuit of FIG. 15 according to the adjustment of variable resistor 136. If the predetermined load required to disable the motor means is not reached, an adjustable reverse mode maximum cycle timer 134 will cause the motor means to be disabled after a predetermined, brief, time to avoid burning out the motor means if the operator were to maintain power to the hand-held unit after the sealing process was completed.

Generally, with respect to the guide block 80, the sealing process is comprised of movement from its position shown in FIG. 11 to its position shown in FIG. 12 and then back again to its position shown in FIG. 11. It is preferred that the operator apply a modest withdrawal force on strap 12 while guide block 80 moves from its position shown in FIG. 12 back to its position shown in FIG. 11 so as to avoid any binding of strap 12 within channel L.

The speed of rotation of shaft 60 and hence of guide block 80 in moving from left to right in FIG. 11 during the beginning of the sealing operation is adjustable by way of adjustable resistor 132. In this manner, the seal tension may be increased or decreased by increasing or decreasing the output voltage applied to the motor means. Thus, the point in which the movement of guide block 80 changes can be adjusted by adjusting resistor 132. The approximate operating voltage is in the preferred embodiment, 24 volts DC causing output shaft 56 to rotate at approximately 1600 RPM.

It should be noted that the reverse mode kick-back timer adjustment means 130 is preferred so as to overcome the instantaneous start-up torque in the reverse direction immediately following the pre-set maximum tension in strap 12 having been reached. In everyday use, an automatic seal machine of the nature disclosed herein may be called upon for substantially constant operation. Therefore, controller logic the same as or similar to that disclosed herein is preferred so that the effect of variations in performance such as bank bag size, strap 12 thickness and strength, and temperature.

Indicia means for identification such as raised markings 99 may be associated with cam members 84 or 85 for imprinting identifying indicia on strap 12, as, for example, a code or name of a financial institution. Said indicia means is preferably unique for each additional machine 50. Further, indicia means (not shown) may be used in association with member 74 which would imprint a code or name on or about head 14 as well. In this manner, indicia means I appears on both strap body 12 and head 14 when enclosing a flexible closure B so that if one managed to dislodge strap 10 and gain access to the contents of closure B, strap 10 is destroyed by virtue of its brittle constitution and a new strap cannot be imprinted with the identical indicia a appeared originally unless the thief had access to the seal machine originally used, which is unlikely.

Preferably, at least one detent 25 should be provided in strap body 12 for the purpose of intentionally creating a stress raiser which will rupture upon the imposition of a predetermined tampering force. The broken strap will provide an indication of tampering. The detent may be disposed either at an oblique angle relative to the elongate centerline of strap 10 or normal thereto dependng upon the degree of sensitivity to tampering desired. The yield strength of the strap at detents 25 should be slightly lower than the yield strength of the locking means so that the strap 10 will break apart at the detent 25 rather than the strap body 12 pulling out of head 14 should the strap be tampered with by sufficient force. The cross-sectional configuration of the detent 25 may be, preferably, triangular, or may also be semi-circular, rectangular, or any other shape which most effectively produces the desired yield limit.

The improved closure strap of the instant invention is preferably comprised of a single piece of an acetal homopolymer such as Delrin or Delrin II. However, the strap 10 may be comprised of any material exhibiting the physical properties required of the instant invention, namely, that of flexibility, very low degree of malleability, brittleness under compression and mechanical homogeneity to ensure predictable behavior under a wide range of applications and conditions.

Figure 7:
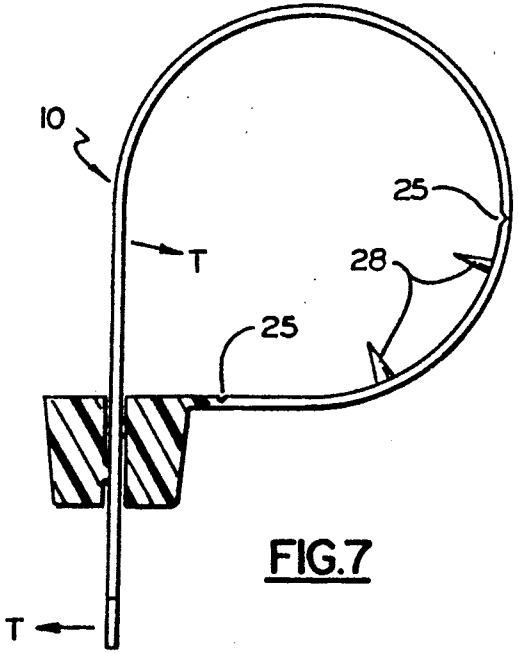
FIG. 7 is an elevational partial cutaway view of the bundling strap of FIG. 1 shown looped upon itself with the body portion thereof passed through the aperture defined by the head-end portion.

As best seen in FIG. 2, the projecting teeth members 34 are raised somewhat in the vertical direction relative to projecting teeth members 36 in head-end portion 14. Because of the inherent resiliency of the material used to manufacture strap 10, there is a built-in tendency for the strap body portion 12 to twist in the direction of arrows T—T of FIG. 7. This twisting causes the trailing edges 26 of serrations 22 to contact more firmly the surfaces 34' and 36' of teeth members 34 and 36, respectively. Further, it is preferred that said teeth members 34 and 36 be staggered in height relative to each other so as to allow sufficient space within aperture 30 through which body portion 12 may pass on insertion of body 12 into head-end 14. Teeth are staggered to also resist tampering by creating a wedge configuration between the serrations 12 and teeth 34 and 36.

In the preferred embodiment, as seen throughout the figures, head-end 14 is tapered from top to bottom on all four sides so that if compressive forces are applied to the head-end 14 by, for example, a pair of pliers, in an attempt to force teeth members 34 and 36 out of engagement with serrations 22, the compressive forces will be more likely concentrated at a single point on either side of head 14 rather than over a substantial surface area thereof, giving rise to the increased likelihood that the head will shatter and thereby indicate tampering. Head 14 may, however, be configured in alternative shapes including that of a three-dimensional rectangle or cube.

Figure 3:
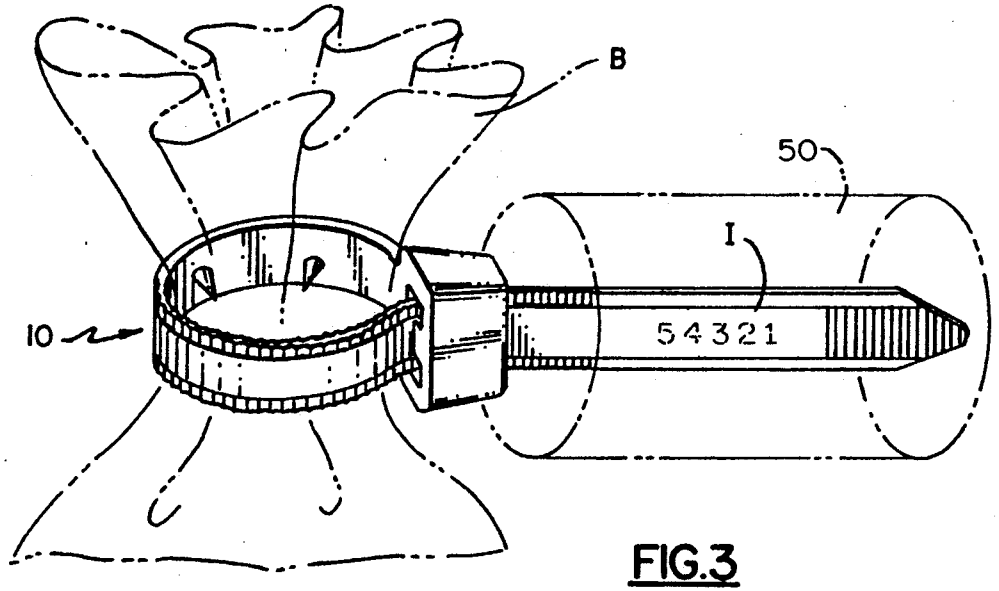
FIG. 3 is a perspective view showing the strap in use about the neck of a flexible container being bundled in association with a tensioning machine therefore.

In the preferred embodiment shown in FIGS. 1 and 3, when the strap 10 is used with the automatic strap tensioning device 50 referred to earlier and shown in FIGS. 8–15, the serrations 22 are absent from the initial length of strap body 12 comprised by end segment 12" and grooves 15 alongside and indicia marking area I so as to provide a sufficient length of strap 10 which can be fed through the head end 14 and gripping jaws 84 and 85 of unit 50 before serrations 22 come into contact with teeth 34 and 36. Grooves 15 allow clearance for strap body 12 to pass between teeth 34 and 36 prior to commencement of the automatic tensioning steps of the method of tensioning of this invention. All of the foregoing permits easier insertion of the strap body 12 into head-end portion 14 to facilitate the efficient and, if desired, rapid application of the strap 10 about items to be bundled or flexible closure B to be sealed.

It should be noted that indicia marking area "I" may be smooth textured or otherwise treated as required to more effectively receive indicia thereon.

It is preferred that at least one sharp piercing means or projection 28 be connected to the underside of body portion 12 when the strap of the instant invention is used in connection with a flexible closure such as a bank bag B, said projection 28 acting to restrain strap 10 from relative movement therewith when pulled taut about the neck of bag B. It can therefore be seen in FIGS. 3 and 7 that projection(s) 28 face inwardly toward the object to be bundled B when the body portion 12 is bent backwardly against itself and passed through aperture 30 in head-end 14.

The instant invention also comprises a method for drawing a bundling strap 10 taut about the neck of a flexible container such as a bank bag B, comprised of the steps of:

looping bundling strap 10 about the open neck of a flexible container B;

inserting the tail end 12" of the strap 10 through an aperture 30 defined in the head-end portion 14 of the strap 10;

pulling said tail-end of said strap completely through said aperture 30 until at least the first set of serrations 22 disposed along opposed side edges of the strap body 12 are engaged by teeth members 34 and 36 projecting upwardly into the interior of the aperture 30, thereby locking the strap body 12 against reverse movement relative to said head-end portion 14;

inserting the tail-end portion 12" of the strap between a pair of strap body gripping jaws 84 and 85 which are disposed for reciprocal movement within an automatic bundling strap tensioning apparatus 50, said gripping jaws adapted to move linearly between an extended position and a retracted position;

causing said gripping jaws 84 and 85 to move from the extended to the retracted position, thereby pulling the strap body 12 through said aperture 30 and closing the neck of the flexible container;

causing said gripping jaws 84 and 85 to move from the retracted toward the extended position to release the strap body 12 from engagement between said gripping jaws.

A further step may be added to the above recited method of imprinting the strap body with indicia using indicia printing means associated with said gripping jaws 84, 85 adapted to imprint indicia upon the strap body, preferably at indicia receiving area "I" located on the strap body.

The instant invention has been shown and described herein in what it is considered to be the most practical and preferred embodiment. It is recognized, however, that departures may be made therefrom within the scope of the invention and that obvious modifications will occur to a person skilled in the art.

What is claimed is:

1. A method for drawing a bundling strap taut about the neck of a flexible container such as a bank bag, said bundling strap comprised of an elongated body means, a head end portion connected to said strap body and defining an aperture sized to accommodate the insertion of at least a portion of said strap body, the method utilizing an automatic bundling strap tensioning apparatus characterized by a reversible motor means connected to a reciprocating means, means for gripping the strap body operably associated with said reciprocating means, said means for gripping adapted to reciprocate on said reciprocating means between an extended position and a retracted position dependent upon the direction of rotation of said power means, comprising the steps of:

looping said bundling strap about the open neck of said flexible container;

inserting a tail end of the strap through the aperture defined by the head end portion of the strap;

pulling said tail end of said strap at least partially through said aperture;

causing said means for gripping to grippingly engage the tail end portion of the strap;

electromechanically causing said means for gripping to move from the extended to the retracted position, thereby pulling the strap body further through said aperture enclosing the neck of the flexible container; and electromechanically causing said means for gripping to move from the retracted toward the extended position while gripping the strap body to at least partially expel the tightened strap from the apparatus and releasing said means for gripping from gripping engagement with said strap body.

* * * * *